US012311282B2

(12) United States Patent
Robbins et al.

(10) Patent No.: US 12,311,282 B2
(45) Date of Patent: May 27, 2025

(54) KIT WITH PLURALITY OF BLOCKS FOR CONSTRUCTING CRAFT

(71) Applicant: Spin Master Ltd., Toronto (CA)

(72) Inventors: Annalee Robbins, Toronto (CA); Matthew Lentini, Toronto (CA); Katherine Pryszlak, Toronto (CA); Scott Lutz, Toronto (CA)

(73) Assignee: Spin Master Ltd., Toronto (CA)

( * ) Notice: Subject to any disclaimer, the term of this patent is extended or adjusted under 35 U.S.C. 154(b) by 310 days.

(21) Appl. No.: 17/936,642

(22) Filed: Sep. 29, 2022

(65) Prior Publication Data

US 2023/0211251 A1 Jul. 6, 2023

Related U.S. Application Data

(60) Provisional application No. 63/295,882, filed on Jan. 1, 2022.

(51) Int. Cl.
*A63H 33/08* (2006.01)
*A63H 33/14* (2006.01)

(52) U.S. Cl.
CPC ..... *A63H 33/086* (2013.01); *A63H 33/14* (2013.01)

(58) Field of Classification Search
CPC ..... A63H 33/04; A63H 33/086; A63H 33/14
USPC ..... 446/85, 87, 118, 124, 128
See application file for complete search history.

(56) References Cited

U.S. PATENT DOCUMENTS

| | | | |
|---|---|---|---|
| 49,242 | A | 8/1865 | Dick |
| 309,629 | A | 12/1884 | Kinsley |
| 1,492,555 | A | 5/1924 | Cooper |
| 1,634,900 | A | 7/1927 | Fuller |
| 2,878,727 | A | 3/1959 | Groot |
| 3,294,284 | A | 12/1966 | Chambers |
| 3,987,558 | A | 10/1976 | Tsukamoto |
| 4,101,284 | A | 7/1978 | Difiglio et al. |
| 4,216,878 | A | 8/1980 | Naud |

(Continued)

FOREIGN PATENT DOCUMENTS

| | | | |
|---|---|---|---|
| CN | 101439233 | A | 5/2009 |
| CN | 103203106 | A | 7/2013 |

(Continued)

OTHER PUBLICATIONS

Moose's BINDEEZ flyer, undated.

(Continued)

*Primary Examiner* — Alexander R Niconovich

(74) *Attorney, Agent, or Firm* — Aird & McBurney LP

(57) ABSTRACT

In an aspect, a kit is provided for constructing a craft, and includes a plurality of blocks. Each block has a main body having an exterior surface that is made from a material that is adherent when exposed to water so as to permit the blocks to adhere to one another. Each block further includes a top surface and a block projection extending from the top surface. Each block further includes a bottom aperture extending into the main body towards the top surface, and defining a longitudinal axis. The bottom aperture includes a first aperture region that is shaped to receive the block projection of the second block of the plurality of blocks. The bottom aperture includes a second aperture region that is shaped to receive a distal portion of a block tray projection on a block tray.

8 Claims, 6 Drawing Sheets

(56) References Cited

U.S. PATENT DOCUMENTS

| | | | | |
|---|---|---|---|---|
| 4,317,306 | A | 3/1982 | Hotti | |
| 4,415,098 | A | 11/1983 | Haas | |
| 5,061,218 | A | 10/1991 | Garage et al. | |
| 5,176,521 | A | 1/1993 | McRae | |
| 5,704,789 | A | 1/1998 | Yang | |
| 5,883,042 | A | 3/1999 | Defieuw | |
| 6,068,158 | A | 5/2000 | Chabout | |
| 6,478,507 | B2 | 11/2002 | Schroeder et al. | |
| 7,056,651 | B1 | 6/2006 | Simpson et al. | |
| 7,424,960 | B1 | 9/2008 | Vokac | |
| 7,615,193 | B2 | 11/2009 | Vann | |
| 9,375,634 | B2 | 6/2016 | Kamiyama | |
| 9,624,407 | B1 * | 4/2017 | Phillips, III | C08L 31/04 |
| 9,956,495 | B2 * | 5/2018 | Kamiyama | A63F 9/06 |
| 10,272,352 | B2 * | 4/2019 | Chazen | A63H 33/14 |
| 10,279,278 | B2 | 5/2019 | Sakai | |
| 10,286,331 | B2 | 5/2019 | Sakai | |
| 10,328,356 | B1 | 6/2019 | Harper | |
| 10,744,420 | B2 | 8/2020 | Sakai | |
| 10,758,813 | B2 * | 9/2020 | Sakai | B44B 9/00 |
| 10,898,821 | B2 * | 1/2021 | Poulus | A63H 33/086 |
| 2003/0207647 | A1 | 11/2003 | Jarvis | |
| 2003/0234488 | A1 * | 12/2003 | Povitz | A63F 9/1208 273/156 |
| 2005/0269346 | A1 | 12/2005 | Limback et al. | |
| 2008/0011770 | A1 * | 1/2008 | Tobias | B44B 9/00 221/189 |
| 2009/0173747 | A1 | 7/2009 | Reynolds | |
| 2010/0289215 | A1 * | 11/2010 | Tan | A63F 9/06 273/156 |
| 2010/0311299 | A1 * | 12/2010 | Rath | A63H 33/14 446/87 |
| 2011/0124263 | A1 | 5/2011 | Cheng | |
| 2011/0192544 | A1 | 8/2011 | Reynolds | |
| 2012/0164424 | A1 | 6/2012 | Vicari et al. | |
| 2012/0186748 | A1 * | 7/2012 | Kamiyama | A63H 9/00 156/349 |
| 2013/0183881 | A1 * | 7/2013 | Kamiyama | B44C 3/12 446/87 |
| 2015/0001245 | A1 | 1/2015 | Kroll et al. | |
| 2016/0271510 | A1 * | 9/2016 | Ho | A63H 33/14 |
| 2016/0354705 | A1 | 12/2016 | Poulus et al. | |
| 2017/0087480 | A1 * | 3/2017 | Poulus | A63H 33/086 |
| 2017/0232354 | A1 | 8/2017 | Arboleda | |
| 2019/0336880 | A1 | 11/2019 | Sakai | |
| 2020/0094131 | A1 | 3/2020 | Sakai | |
| 2024/0238690 | A1 * | 7/2024 | Sakai | A63H 33/14 |

FOREIGN PATENT DOCUMENTS

| | | | |
|---|---|---|---|
| DE | 3519187 | A1 | 12/1986 |
| DE | 202015000531 | U1 | 2/2015 |
| DE | 102019004414 | A1 | 12/2020 |
| EP | 1842797 | A2 | 10/2007 |
| EP | 1847404 | A2 | 10/2007 |
| EP | 3302745 | A1 | 4/2018 |
| EP | 3834897 | A1 | 6/2021 |
| JP | 3131292 | U1 | 4/2007 |
| JP | 2012232002 | A | 11/2012 |
| JP | 2018143640 | A | 9/2018 |
| JP | 2019098003 | A | 6/2019 |
| JP | 3226098 | U1 | 4/2020 |
| JP | 2021058721 | A | 4/2021 |
| WO | 1989007001 | A1 | 8/1989 |
| WO | 2014070743 | A1 | 5/2014 |

OTHER PUBLICATIONS

EP22209802: Extended European Search Report dated Sep. 11, 2023.

EP22209804.8: Extended European Search Report dated Sep. 12, 2023.

XP054978003 Qixels From Moose Toys First Look at Toy Fair 2015.

XP055439456 Crafting Table Instructions, Mattel Crafting Cubes Design Kit.

* cited by examiner

KIT WITH PLURALITY OF BLOCKS FOR CONSTRUCTING CRAFT

CROSS-REFERENCE TO RELATED APPLICATIONS

This application claims the benefit of U.S. Provisional Application No. 63/295,882, filed Jan. 1, 2022, the contents of which are incorporated herein by reference in their entirety.

FIELD OF THE DISCLOSURE

The present invention relates generally to blocks for constructing crafts, and more particularly to blocks that are adherable to one another for constructing crafts.

BACKGROUND OF THE DISCLOSURE

Kits have been provided in the past, containing a plurality of beads that were made of a material that, when exposed to water, became adherent to one another. Some kits were difficult to use because the beads where spherical and did not therefore have large areas of contact with one another. Additionally, the beads were in some cases generally small and therefore difficult to place with one's hands. Additionally, spherical beads were difficult to stack directly one on top of the other due to the inherently unstable arrangement of a sphere sitting on top of another sphere. Accordingly, to build a structure with vertical walls that were relatively smooth, one sometimes resorted to building individual layers of the structure individually, and then stacking the layers on top of one another, which can be time-consuming to inhibit a user from initiating such a task. Yet another problem that arises with some kits is the potential for the beads to adhere to the bead tray on which they are placed.

It would be advantageous to provide a kit for producing a craft that addresses one or more of the problems identified above or other problems that are present with some kits.

SUMMARY OF THE DISCLOSURE

In an aspect, a kit is provided for constructing a craft, and includes a plurality of blocks. Each block has a main body having an exterior surface that is made from a material that is adherent when exposed to water so as to permit a first block from the plurality of blocks to be adherable to a second block of the plurality of blocks by applying water to at least one of the first and second blocks. Each block further includes a top surface and a block projection extending from the top surface. Each block further includes a bottom aperture extending into the main body towards the top surface. The bottom aperture includes a first aperture region that has a plurality of first region sidewalls, which are connected to one another by a plurality of first region corners each having a first average radius. The first aperture region is shaped to receive the block projection of the second block of the plurality of blocks. The bottom aperture includes a second aperture region that has a plurality of second region sidewalls, which are connected to one another by a plurality of second region corners each having a second average radius that is greater than the first average radius.

In another aspect, a kit is provided for constructing a craft, and includes a plurality of blocks. Each block has a main body having an exterior surface that is made from a material that is adherent when exposed to water so as to permit a first block from the plurality of blocks to be adherable to a second block of the plurality of blocks by applying water to at least one of the first and second blocks. Each block further includes a top surface and a block projection extending from the top surface. Each block further includes a bottom aperture extending into the main body towards the top surface, and defining a longitudinal axis. The bottom aperture includes a first aperture region that is shaped to receive the block projection of the second block of the plurality of blocks. The bottom aperture includes a second aperture region that is shaped to receive a distal portion of a block tray projection on a block tray.

In yet another aspect, a kit is provided for constructing a craft, and includes a plurality of blocks and a block tray. The block tray includes a block tray projection having a proximal portion and a distal portion. Each block having a main body has an exterior surface that is made from a material that is adherent when exposed to water so as to permit a first block from the plurality of blocks to be adherable to a second block of the plurality of blocks by applying water to at least one of the first and second blocks. Each block further includes a top surface and a block projection extending from the top surface. Each block further includes a bottom aperture extending into the main body towards the top surface, and defining a longitudinal axis. The bottom aperture includes a first aperture region that is shaped to receive the block projection of the second block of the plurality of blocks. The bottom aperture includes a second aperture region that is shaped to receive the distal portion of the block tray projection.

In yet another aspect, a kit is provided for constructing a craft, and includes a plurality of blocks and a block tray. The block tray includes a block tray projection including a limit surface. Each block has a main body having an exterior surface that is made from a material that is adherent when exposed to water so as to permit a first block from the plurality of blocks to be adherable to a second block of the plurality of blocks by applying water to at least one of the first and second blocks. Each block further including a bottom aperture extending into the main body. The bottom aperture includes a first aperture region that is shaped to receive the block tray projection. The bottom aperture includes a shoulder that defines a depth of the first aperture region. The depth of the first aperture region is selected such that the shoulder is positioned to engage the limit surface on the block tray to hold a lowermost surface of one of the plurality of blocks above a floor of the block tray that surrounds the block tray projection.

In another aspect, a kit is provided for constructing a craft, and includes a plurality of blocks. Each block has a main body having an exterior surface that is made from a material that is adherent when exposed to water so as to permit a first block from the plurality of blocks to be adherable to a second block of the plurality of blocks by applying water to at least one of the first and second blocks. Each block further includes a bottom aperture extending into the main body. The bottom aperture includes a first aperture region that is shaped to receive a block tray projection on a block tray. The bottom aperture includes a shoulder that defines a depth of the first aperture region. The depth of the first aperture region is selected such that the shoulder is positioned to engage a limit surface on the block tray to hold a lowermost surface of one of the plurality of blocks above a floor of the block tray that surrounds the block tray projection.

BRIEF DESCRIPTION OF THE DRAWINGS

Embodiments will now be described, by way of example only, with reference to the attached figures, as follows.

DETAILED DESCRIPTION OF EMBODIMENTS

Throughout the present disclosure, it will be understood that the term "an" to introduce an element is not intended to mean "one and only one" of that element. It is intended to mean "one or more" of that element, unless it would be obvious to one skilled in the art that more than one of the element would be unusable.

Figure 1:
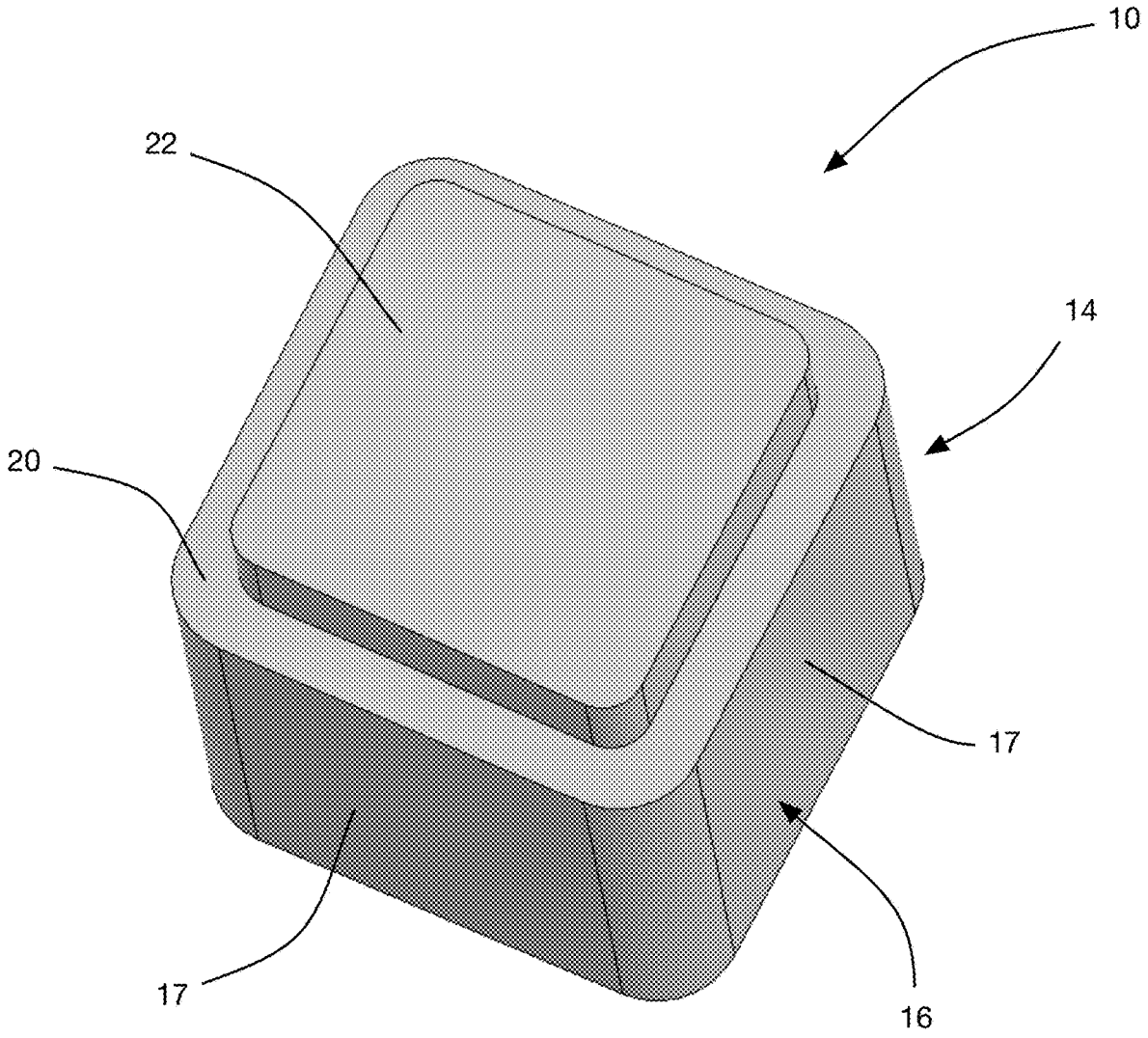
FIG. 1 is a perspective view of a block for use in producing a craft in accordance with an embodiment of the present disclosure.
Figure 8:
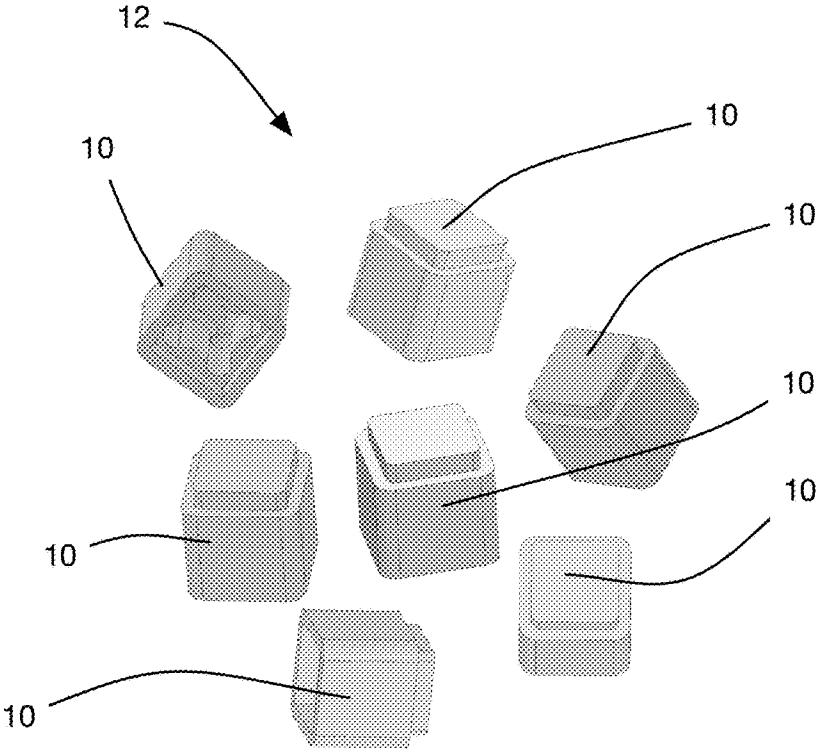
FIG. 8 is a perspective view of a kit that includes a plurality of the block shown in FIG. 1.

Reference is made to FIG. 1, which shows a block 10 in accordance with an embodiment of the present disclosure. The block 10 may be part of a kit for constructing a craft, wherein the kit is shown at 12 in FIG. 8. The kit 12 includes a plurality of the blocks 10. Seven blocks 10 are shown in FIG. 8, however, it will be understood that the kit 12 may include more or fewer of the blocks 10. In some cases there may be hundreds of the blocks 10 provided in the kit 12.

Each block 10 has a main body 14, which has an exterior surface 16 that is made from a material that is adherent when exposed to water so as to permit a first block (shown in FIG. 9, at 10*a*) from the plurality of blocks 10 to be adherable to a second block (shown at 10*b*) of the plurality of blocks 10 by applying water (shown at 18) to at least one of the first and second blocks. The material may become adherent, for example, by dissolving somewhat in the water 18, and then resolidifying once the water evaporates, thereby fusing blocks 10 that are adjacent one another when wetted. A suitable material may be, for example, polyvinyl alcohol (PVA). Any other suitable material may alternatively or additionally be used. The entire block 10 may be formed from the material, or alternatively may include a core from a first material, and an outer layer of the adherent material such as PVA.

The exterior surface 16 may include a plurality of generally planar (i.e. flat) exterior sidewalls 19 so as to promote surface-to-surface contact between adjacent blocks 10, thereby promoting adhesion therebetween. However, it is contemplated that any other suitable shape may be provided to the exterior surface 16.

Each block 10 further includes a top surface 20 and a block projection 22 extending from the top surface 20. The block projection 22 is shown as having a generally square shape, however, other shapes such as arcuate shapes, polygonal shapes other than a square shape, shapes that are combinations of arcuate surfaces and polygon faces, or any other suitable shapes are contemplated. As can be seen, the block projection 22 has a height H1 (FIG. 10) from the top surface 20, which is described further below.

Figure 3:
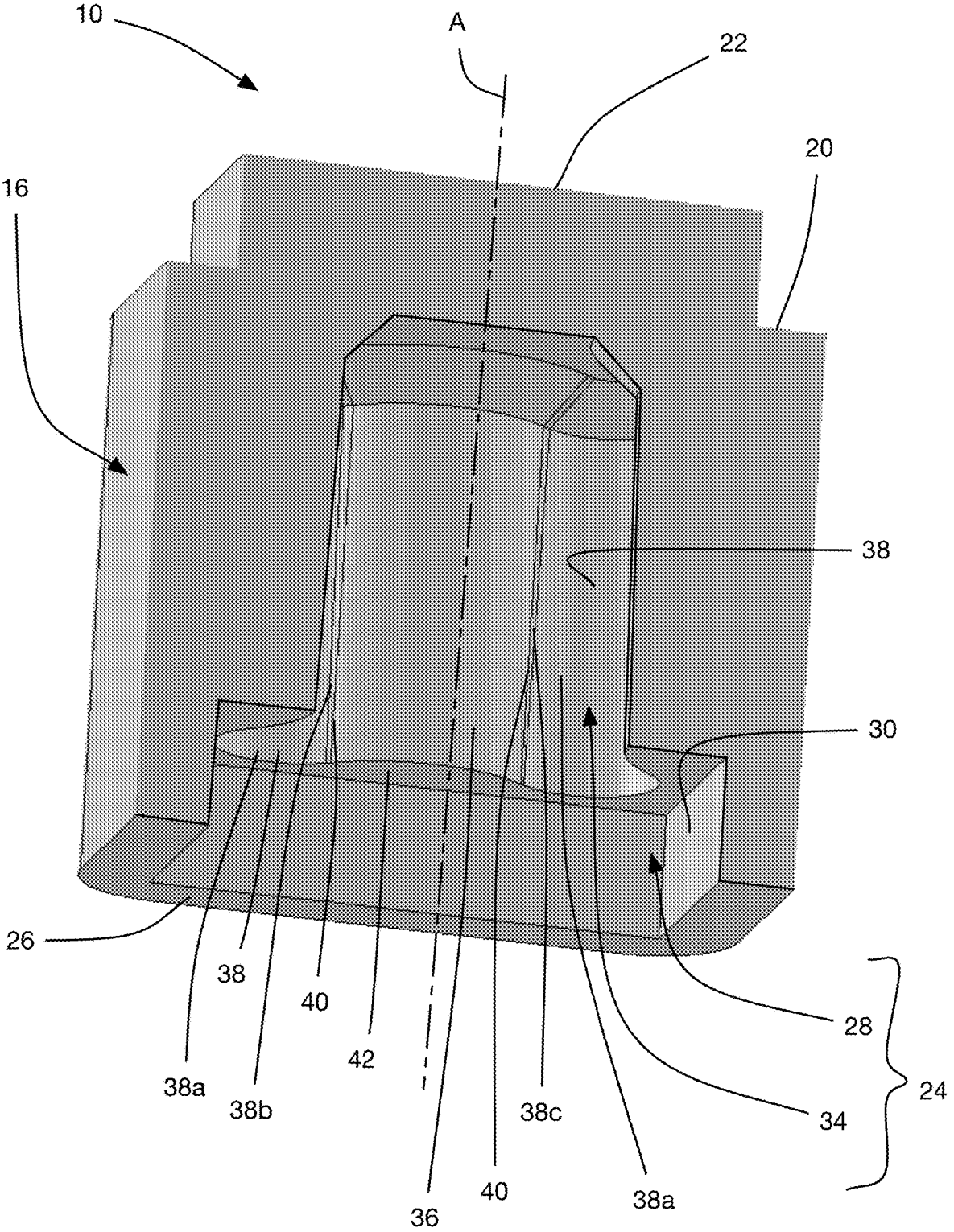
FIG. 3 is a sectional perspective view of the block shown in FIG. 1.

Each block 10 further includes a bottom aperture 24 extending into the main body 14. The bottom aperture 24 may extend from a lowermost surface shown at 26, and my extend towards the top surface 20. The bottom aperture 24 may define a longitudinal axis A for the block 10 (FIG. 3).

The bottom aperture 24 includes a first aperture region 28. The first aperture region 28 is shaped to receive the block projection 22 of the second block 10*b* (FIG. 10) of the plurality of blocks 10.

Figure 2:
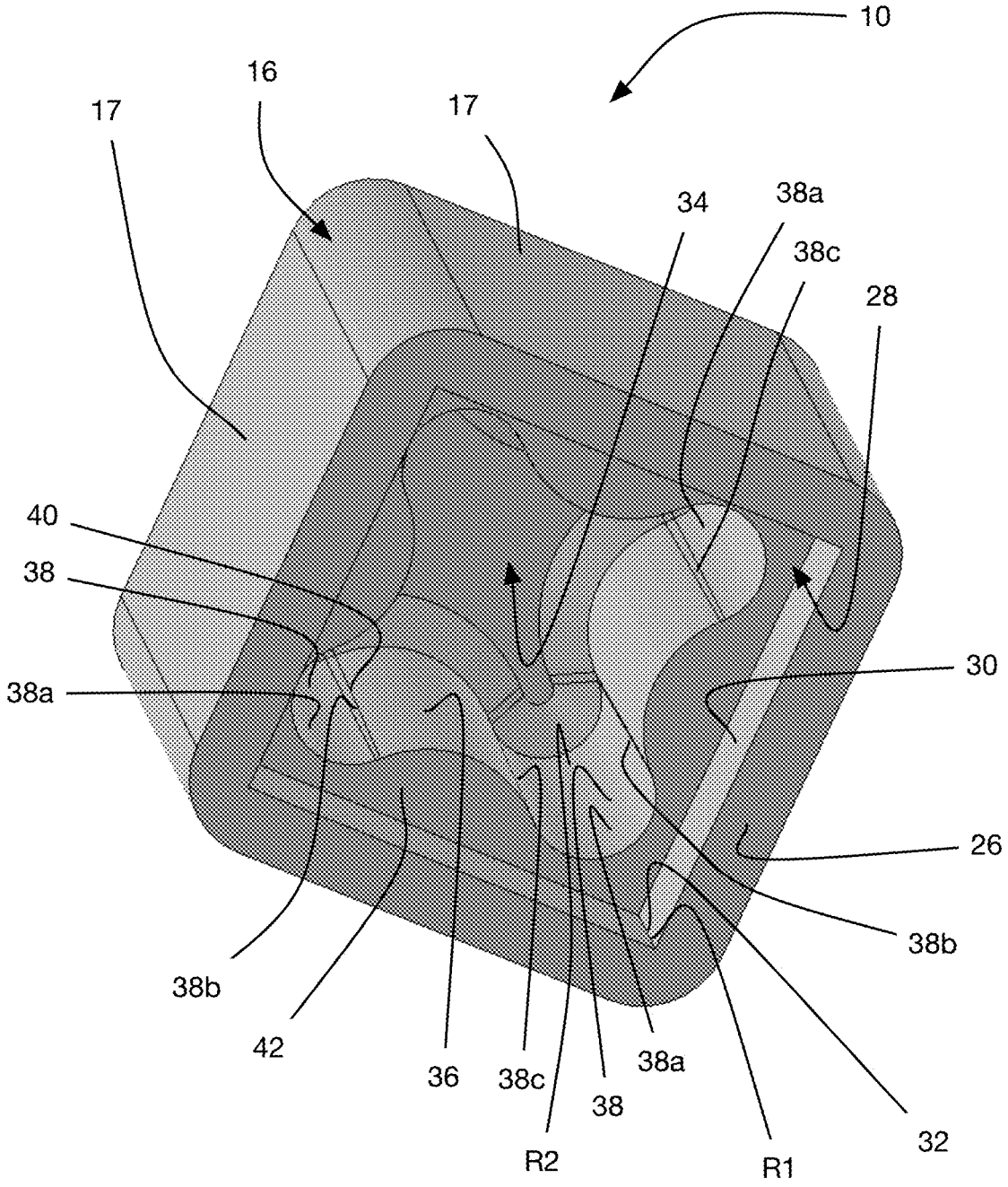
FIG. 2 is another perspective view of the block shown in FIG. 1.

The first aperture region 28 has a plurality of walls including a plurality of first region sidewalls 30 and a plurality of first region corners 32. The first region sidewalls 30 are connected to one another by the plurality of first region corners 32. Each first region corner 32 has a first average radius R1 (FIG. 2). The first average radius R1 is the average of the radii of all surfaces that make up the corner between two adjacent sidewalls 30 (not counting any flat surfaces). This average may be a weighted average based on the widths of the individual surfaces, or may be determined in any other suitable way. In the example shown, the first average radius R1 is small—less than 0.1 mm and may be considered approximately zero.

The bottom aperture 24 further includes a second aperture region 34 that extends into the main body 14 from the first aperture region 28. The second aperture region 34 has a plurality of second region sidewalls 36, which are connected to one another by a plurality of second region corners 38. Each second region corner 38 has a second average radius R2 (FIG. 2), may be determined using an analogous method to that which is used for determining the first average radius R1. The second average radius R2 is greater than the first average radius R1. In the example shown, a parting line between one of the second region sidewalls 36 and one of the second region corners 38 is shown at 40. In the example shown, the second average radius R2 is the weighted average radius of three surfaces shown at 38*a*, 38*b* and 38*c*. Given that the surface 38*a* is so much larger than the surfaces 38*b* and 38*c*, the second average radius will be relatively close to the radius of the surface 38*a*. It can be seen visually that the second average radius R2 is much larger than the first average radius R1.

Figure 10:
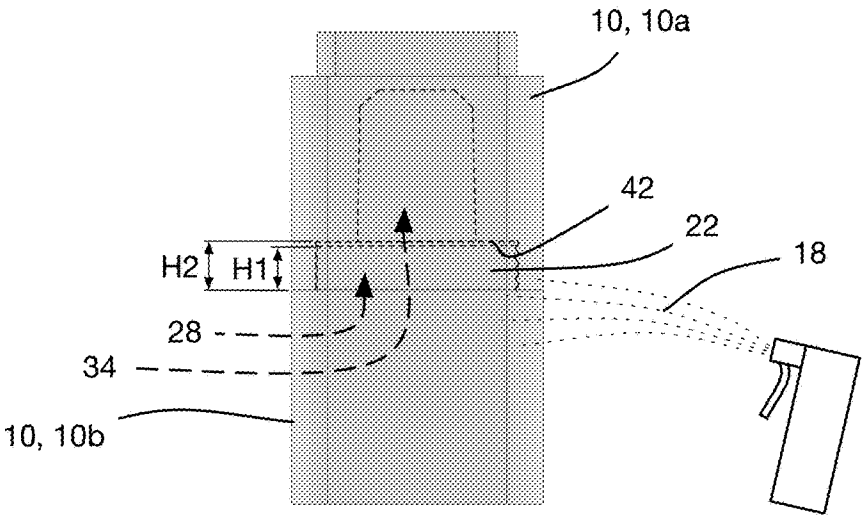
FIG. 10 is an elevation view of two blocks from the kit shown in FIG. 8, stacked on top of one another, with water applied thereto, being adhered together.

The bottom aperture 24 includes a shoulder 42 between the first aperture region 28 and the second aperture region 34. The shoulder 42 defines a depth H2 (FIG. 10) of the first aperture region 28. As can be seen in FIG. 10, the depth H2 of the first aperture region 28 is greater than the height H1 of the block projection 22, such that the lowermost surface 26 of the first block 10*a* can contact the top surface 20 of the second block 10*b*, thereby facilitating their adherence together.

By providing the first aperture region 28 that is shaped to receive the block projection 22 of the second block 10*b*, and by providing the second aperture region 34 that has the second average radius R2 for the second region corners 38 that is larger than the first average radius R1, the second aperture region 34 provides added strength at the corners of the block 10 that would not be present if the entire bottom aperture 24 was shaped like the first aperture region 28.

Additionally, it can be seen that the second region sidewalls 36 progressively increase in thickness with increasing distance from the second region corners 38. This shape strengthens the second region sidewalls 36 against forces exerted thereon, while still conserving material used in the manufacture of the block 10. In other words, by providing the increase in thickness away from the second region corners 38, the material that makes up the block 10 is used where it is most needed to resist stresses that may be applied to it during use. This may also help the block 10 maintain its shape and inhibit warpage during manufacture, as compared to a block 10 where the entire bottom aperture 24 is like the first aperture region 28. In the example block 10 shown in the figures, the peak thickness of each second region sidewall 36 is centered between the second region corner 38 on either side of it.

In the example shown, the main body 14 of the block 10 has four corners, and the first aperture region 28 has four first region corners 32 and four first region sidewalls 30, and the second aperture region 34 has four second region corners 38 and four second region sidewalls 36. However, any other suitable number of corners and sidewalls may be used for each of the first and second aperture regions. Furthermore, the first and second aperture regions need not have the same number of corners as one other, and therefore need not have the same number of sidewalls as one another.

Figure 4:
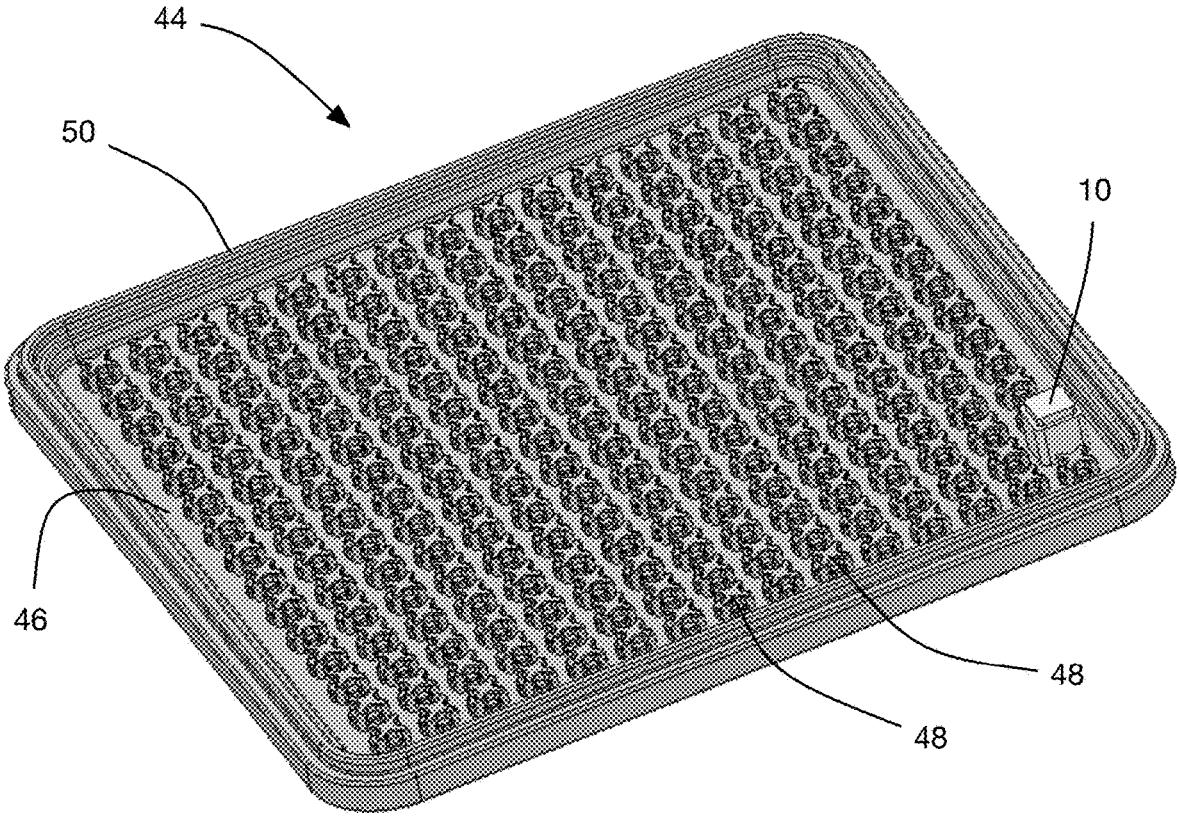
FIG. 4 is a perspective view of a block tray that can be used with the block shown in FIG. 1.
Figure 5:
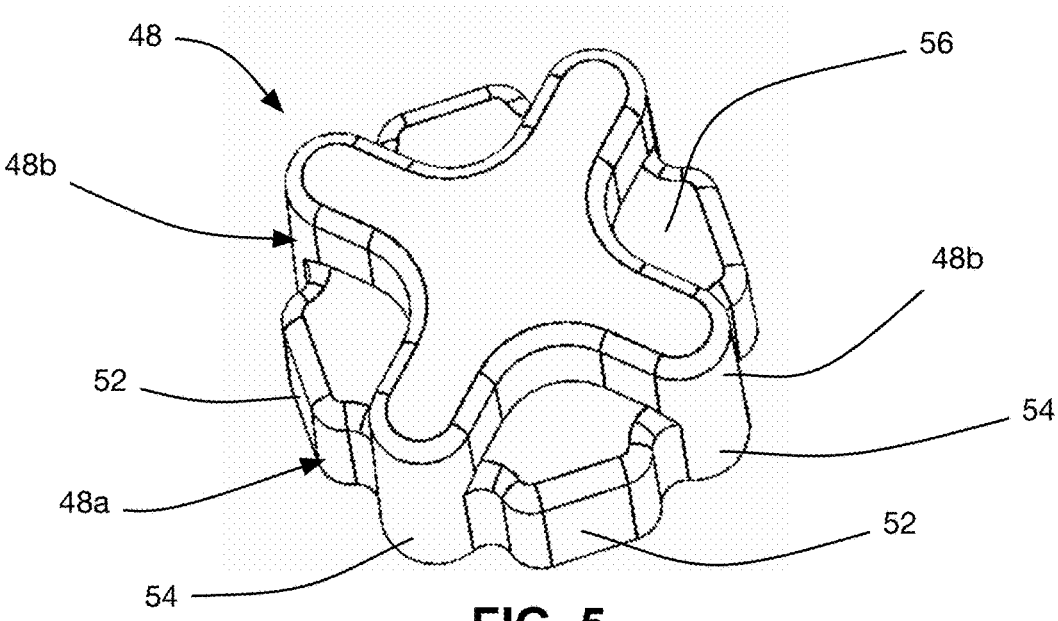
FIG. 5 is a perspective view of one block tray projection from among a plurality of block tray projections that are present on the block tray shown in FIG. 4.

Referring to FIG. 4, the kit 12 may include a block tray 44 that is shaped to receive blocks 10 for assisting in creating a craft therewith. The block tray 44 includes a floor 46, a plurality of block tray projections 48 that extend upwards from the floor 46, and an edge wall 50 that surrounds the floor 44.

The block tray projections 48 are shaped to receive blocks 10 thereon and to position the blocks 10 so as to have the exterior surfaces 16 thereof be in contact with one another.

The floor 46 is provided to collect water that is sprayed onto the blocks 10 during the craftmaking process. The edge wall 50 is provided to prevent the water collected on the floor 46 of the block tray 44, from spilling off onto the table or other support surface on which the block tray 44 is positioned.

Magnified views of one of the block tray projections 48 are shown in FIGS. 5, 6, 7A and 7B. The block tray projection 48 may, in some embodiments, include a proximal portion 48*a* and a distal portion 48*b*. The first aperture region 28 of the bottom aperture 24 of each block 10 may be shaped to receive the proximal portion 48*a* of each block tray projection 48. In some embodiments, the proximal portion 48*a* includes a plurality of locating surfaces 52 that are engageable with the first region sidewalls 30 of the first aperture region 28 to securely position the block 10 in a selected position on the block tray 44. The proximal portion 48*a* further includes a plurality of air passage surfaces 54 that are positioned to be spaced from the block 10 when the block 10 is mounted thereon, to ensure that any water that inadvertently winds up in the bottom aperture 24 of the block 10 has a way of draining out.

Figure 6:
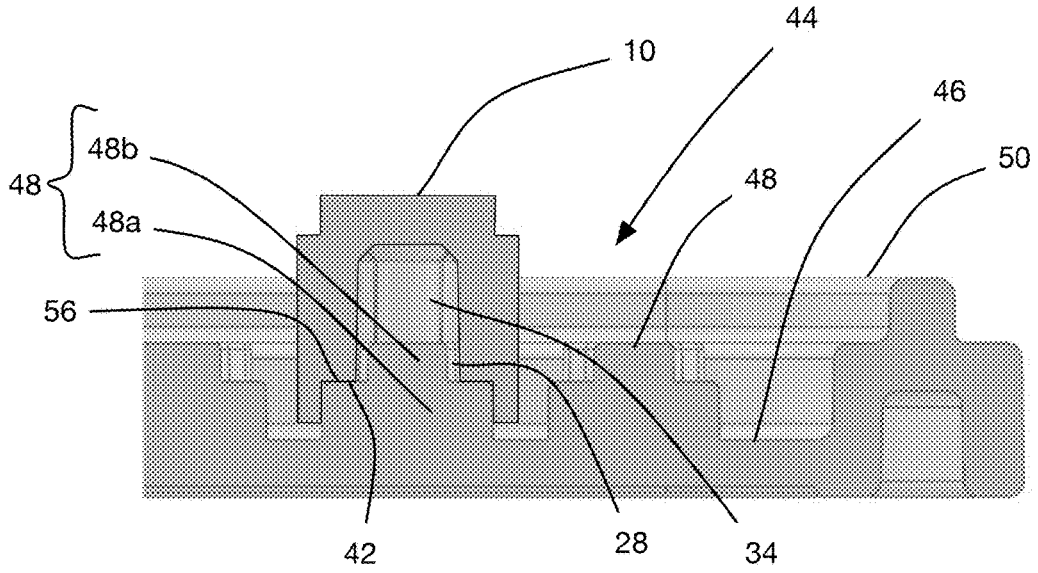
FIG. 6 is a sectional elevation view a portion of the block tray shown in FIG. 4 with the block shown in FIG. 1 thereon.

A limit surface 56 may be provided on the block tray projection 48. In the embodiment shown, the limit surface 56 is provided between the first portion 48*a* and the second portion 48*b* of the block tray projection 48. When the block 10 is positioned on the block tray projection 48, the limit surface 56 engages the shoulder 42 on the block 10. It may be said, that the limit surface 56 is positioned in a selected position on the block tray 44 to hold the lowermost surface 26 of the block 10 above the floor 46 of the block tray 44 that surrounds the block tray projection 48, as can be seen in FIG. 6. As a result, the block 10 is essentially prevented from adhering to the floor 46. It may also be said that the depth H2 of the first aperture region 28 of the block 10 is selected such that the shoulder 42 is positioned to engage the limit surface 56 on the block tray 10 to hold the lowermost surface 26 of the block 10 above the floor 46 of the block tray 46 that surrounds the block tray projection 48.

The second aperture region 34 of the bottom aperture 24 of each block 10 may be shaped to receive the distal portion 48*b* of each block tray projection 48. Alternatively it may be said that the distal portion 48*b* of each block tray projection 48 may be shaped to receive the second aperture region 34 of the bottom aperture 24 of each block 10.

In some embodiments, the distal portion 48*b* may generally conform to the shape of the second aperture region 34 but may be spaced entirely from the walls of the second aperture region 34, so as to provide some increased stability to the block 10 resting thereon by inhibiting excessive tilting of the block 10 while the block 10 sits thereon, while also inhibiting the block 10 from adhering thereto in the event that any water is present therebetween, thereby facilitating removal of the block 10 therefrom once the craft is completed. Additionally, the spacing between the second portion 48*b* of the block try projection 48 and the walls of the second aperture region 34 facilitate water drainage in the event that there is any water on top of the block tray projection 48 or in the second aperture region 34 of the block 10 when the block 10 is mounted onto the block tray projection 48. As can be seen in FIG. 7B, there is a first minimum clearance G1 between the first aperture region 28 and the proximal portion 48*a* of the block tray projection 48. The first minimum clearance G1 is the clearance at the point where proximal portion 48*a* and the walls of the first aperture region 28 are closest to one another. This occurs in the example shown between any of the locating surfaces 52 and the first region side walls 30. The first minimum clearance G1 may be zero in embodiments in which the locating surfaces 52 and the first region side walls 30 contact one another when the block 10 is mounted to the block tray projection 48, as is the case in the example shown in FIG. 7B. Alternatively, the first minimum clearance G1 could be some other value, such as, for example 1 mm.

Figure 7A:
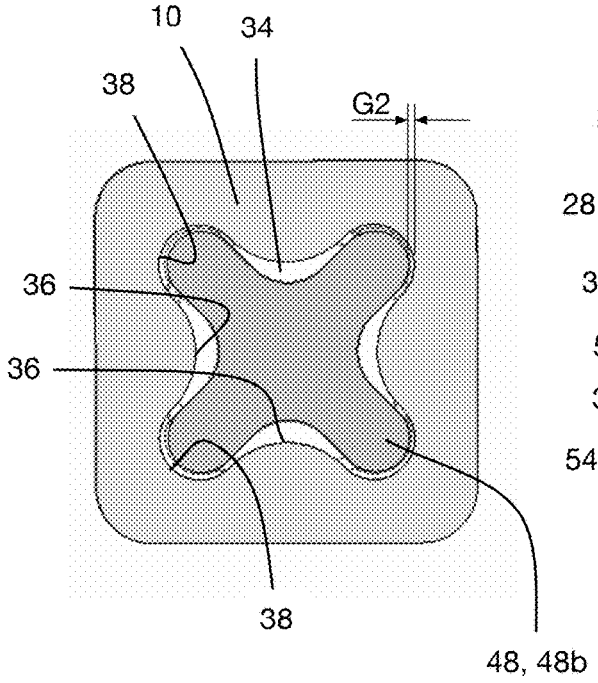
FIG. 7A is a sectional plan view of the block on the block tray shown in FIG. 6, at a first elevation.
Figure 7B:
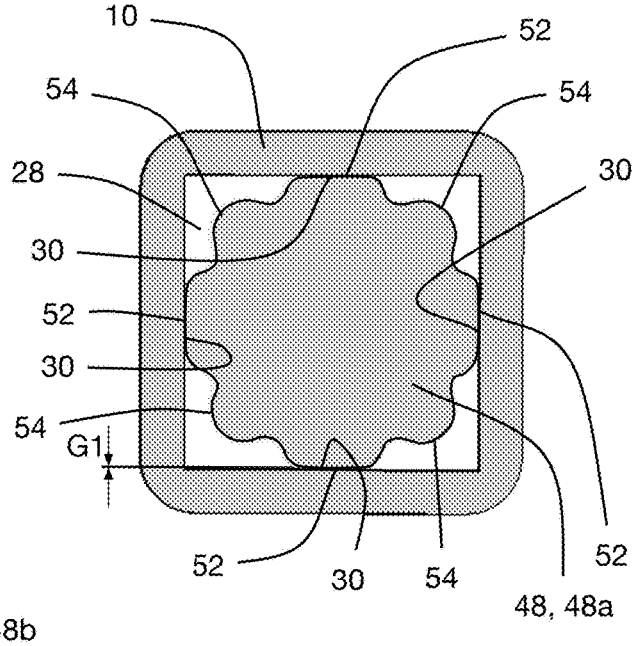
FIG. 7B is another sectional plan view of the block on the block tray shown in FIG. 6, at a second elevation.

As can be seen in FIG. 7A, there is a second minimum clearance G2 between the second aperture region 34 and the distal portion 48*b* of the block tray projection 48. The second minimum clearance G2 is the clearance at the point where proximal portion 48*b* and the walls of the second aperture region 34 are closest to one another. The second minimum clearance G2 is larger than the first minimum clearance, which provides at least some of the advantages outlined above. In some embodiments, the second minimum clearance G2 may be in the range of 1-2 mm, in order to provide the advantages outlined above in relation to inhibiting adherence to the second portion 48*b* of the block tray projection 48 by the block 10. Based on the above, it may be said that the first aperture region 28 is sized to have a first minimum clearance G1 relative to the proximal portion 48*a* of the block tray projection 48, and the second aperture region 34 is sized to have a second minimum clearance G2 relative to the distal portion 48*b* of the block tray projection 48, wherein the first minimum clearance G1 is smaller than the second minimum clearance G2.

Figure 9:
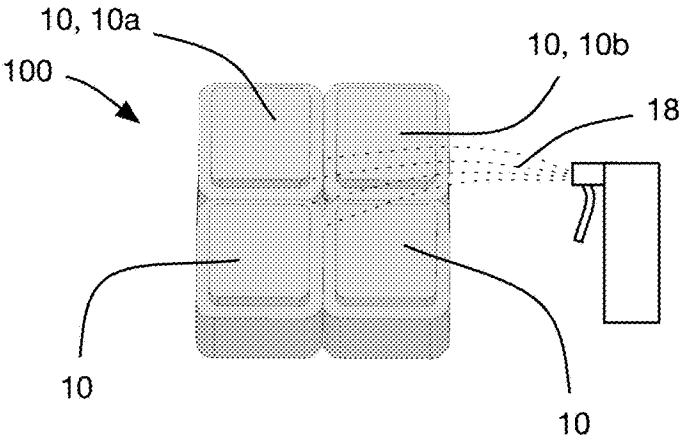
FIG. 9 is a perspective view of a plurality of the blocks from the kit shown in FIG. 8, with water applied thereto, being adhered together.

An example of a simple craft is shown at 100 in FIG. 9, which is formed from four blocks 10 that are adhered together.

While it has been shown for the kit 12 to optionally include the block tray 44 shown in FIG. 4, it will be understood that the kit 12 might not include the block tray 44, but may include a plurality of blocks 10 that are shaped, in at least some embodiments, to be received on a pre-existing block tray 44, as described herein.

The above-described embodiments are intended to be examples of the present invention and alterations and modifications may be effected thereto, by those of skill in the art, without departing from the scope of the invention that is defined solely by the claims appended hereto.

What is claimed is:

1. A kit for constructing a craft, comprising:

a plurality of blocks, each block having a main body having an exterior surface that is made from a material that is adherent when exposed to water so as to permit a first block from the plurality of blocks to be adherable to a second block of the plurality of blocks by applying water to at least one of the first and second blocks, each block further including a top surface and a block projection extending from the top surface, each block further including a bottom aperture extending into the main body towards the top surface, and defining a longitudinal axis, wherein the bottom aperture includes a first aperture region that has a plurality of first region sidewalls, which are connected to one another by a plurality of first region corners each having a first average radius, wherein the first aperture region is shaped to receive the block projection of the second block of the plurality of blocks, and wherein the bottom aperture includes a second aperture region that has a plurality of second region sidewalls, which are connected to one another by a plurality of second region corners each having a second average radius that is greater than the first average radius.

2. The kit as claimed in claim 1, wherein the second region sidewalls progressively increase in thickness with increasing distance from the second region corners.

3. The kit as claimed in claim 1, wherein the second aperture region is shaped to receive a distal portion of a block tray projection on a block tray.

4. The kit as claimed in claim 3, wherein the first aperture region is shaped to receive a proximal portion of the block tray projection.

5. The kit as claimed in claim 4, wherein the bottom aperture includes a shoulder between the first aperture region and the second aperture region that defines a depth of the first aperture region, wherein the depth of the first aperture region is selected such that the shoulder is positioned to engage a limit surface on the block tray to hold a lowermost surface of one of the plurality of blocks above a floor of the block tray that surrounds the block tray projection.

6. A kit for constructing a craft, comprising:

a plurality of blocks, each block having a main body having an exterior surface that is made from a material that is adherent when exposed to water so as to permit a first block from the plurality of blocks to be adherable to a second block of the plurality of blocks by applying water to at least one of the first and second blocks, each block further including a top surface and a block projection extending from the top surface, each block further including a bottom aperture extending into the main body towards the top surface, and defining a longitudinal axis, wherein the bottom aperture includes a first aperture region that is shaped to receive the block projection of the second block of the plurality of blocks, and wherein the bottom aperture includes a second aperture region that is shaped to receive a distal portion of a block tray projection on a block tray, wherein the first aperture region is shaped to receive a proximal portion of the block tray projection, wherein the bottom aperture includes a shoulder between the first aperture region and the second aperture region that defines a depth of the first aperture region, wherein the depth of the first aperture region is selected such that the shoulder is positioned to engage a limit surface on the block tray to hold a lowermost surface of one of the plurality of blocks above a floor of the block tray that surrounds the block tray projection.

7. The kit as claimed in claim 6, wherein the first aperture region is sized to have a first minimum clearance relative to the proximal portion of the block tray projection, and the second aperture region is sized to have a second minimum clearance relative to the distal portion of the block tray projection, wherein the first minimum clearance is smaller than the second minimum clearance.

8. A kit for constructing a craft, comprising:

a plurality of blocks, each block having a main body having an exterior surface that is made from a material that is adherent when exposed to water so as to permit a first block from the plurality of blocks to be adherable to a second block of the plurality of blocks by applying water to at least one of the first and second blocks, each block further including a top surface and a block projection extending from the top surface, each block further including a bottom aperture extending into the main body towards the top surface, and defining a longitudinal axis, wherein the bottom aperture includes a first aperture region that is shaped to receive the block projection of the second block of the plurality of blocks, and wherein the bottom aperture includes a second aperture region that is shaped to receive a distal portion of a block tray projection on a block tray, wherein the first aperture region is shaped to receive a proximal portion of the block tray projection, wherein the first aperture region is sized to have a first minimum clearance relative to the proximal portion of the block tray projection, and the second aperture region is sized to have a second minimum clearance relative to the distal portion of the block tray projection, wherein the first minimum clearance is smaller than the second minimum clearance.

* * * * *